United States Patent [19]

Higgins, Jr.

[11] Patent Number: 4,785,271

[45] Date of Patent: Nov. 15, 1988

[54] STRIPLINE FILTER WITH IMPROVED RESONATOR STRUCTURE

[75] Inventor: Robert J. Higgins, Jr., Sunrise, Fla.

[73] Assignee: Motorola, Inc., Schaumburg, Ill.

[21] Appl. No.: 124,639

[22] Filed: Nov. 24, 1987

[51] Int. Cl.[4] ..... H01P 1/203; H01P 7/08

[52] U.S. Cl. ..... 333/204; 333/219; 333/222; 333/246; 29/600

[58] Field of Search ..... 333/202, 203, 204, 219, 333/222, 236, 238, 246, 243, 244, 116, 128; 29/600

[56] References Cited

U.S. PATENT DOCUMENTS 2,810,892 10/1957 Blitz ..... 333/238
4,609,892 9/1986 Higgins, Jr. ..... 333/204

FOREIGN PATENT DOCUMENTS 0062202 4/1985 Japan ..... 29/600
2165098A 4/1986 United Kingdom .

OTHER PUBLICATIONS

"Microwave Filters, Impedance-Matching Networks, and Coupling Structures", Matthaei, et al., Copyright 1980, reprint of edition published by McGraw-Hill Book Co., Inc. in 1964, pp. 172-175, 631.

*Primary Examiner*—Marvin L. Nussbaum
*Attorney, Agent, or Firm*—Mark P. Kahler; Martin J. McKinley

[57] ABSTRACT

A stripline filter resonator structure is provided which exhibits high Q and results in a filter with low insertion loss. The dielectric consists of two sections of dielectric material. A groove shaped as half an ellipse is formed in each of the sections. The surface of the grooves are covered with electrically conductive material. The two grooves are aligned and filled with adhesive material to hold the two dielectric sections together. An elliptically shaped resonator is thus formed in the center of the dielectric sandwich. Ground plane layers are respectively situated on the outer layers of the dielectric sandwich thus forming a stripline resonator structure. This unique resonator structure results in a more uniform current density around the periphery and thus undesired current bunching is correspondingly decreased.

5 Claims, 5 Drawing Sheets

—PRIOR ART—

—PRIOR ART—

—PRIOR ART—

-PRIOR ART-

-PRIOR ART-

-PRIOR ART-

STRIPLINE FILTER WITH IMPROVED RESONATOR STRUCTURE

BACKGROUND OF THE INVENTION

This invention relates in general to stripline filters. More particularly, the invention relates to the structure of the resonators employed in such stripline filters.

Those skilled in the art use the term "stripline" to refer to structures which include a layer of dielectric material having opposed surfaces on which respective layers of electrically conductive material are disposed. One or more resonators are sandwiched within the dielectric layer to fabricate as stripline filter structure.

For example, FIG. 1 shows one such conventional sandwiched stripline resonator structure as stripline structure 10 prior to completion of fabrication. Stripline structure 10 includes layers 20 and 30 of dielectric material such as Teflon® material. Layer 20 includes opposed major surfaces 20A and 20B. Layer 30 includes opposed major surfaces 30A and 30B. Ground plane layers 40 and 50 of electrically conductive material are situated on surfaces 20A and 30B, respectively, as shown. A perspective view of stripline structure 10 is shown in FIG. 2 to more clearly illustrate the components thereof. A resonator 60 is disposed on surface 30A as shown in FIG. 2. Resonator 60 is a substantially rectangular strip of electrically conductive material having a length corresponding to the frequency at which resonator 60 is desired to resonate.

To complete fabrication of stripline structure 10, dielectric layers 20 and 30 are situated adjacent each other as shown in FIG. 3. The combined stripline structure is then heated such that Teflon® dielectric layers 20 and 30 become plastic and encapsulate resonator 60 therebetween.

Although the stripline resonator structure of FIG. 3 performs acceptably as a resonator, it exhibits current bunching at the cross-sectional corners thereof. FIG. 4 shows a simplified representation of current density at different points around the periphery of the cross-section of the rectangular resonator 60. Significant current bunching is observed at resonator corners 60A, 60B, 60C and 60D. This nonuniform current density or current bunching effectively increases the alternating current resistance exhibited by resonator 60. It is well known that such increases in resonator resistance correspondingly degrade the quality factor or Q of the resonator.

For purposes of this document, $Q_U$ is defined as the unloaded quality factor of a particular resonator which is uncoupled to any adjacent resonators. $Q_L$ is defined as the loaded quality factor of a particular resonator which is coupled to a resistive source or load. The ratio $Q_L/Q_U$ of adjacent resonators determines the passband insertion loss of a stripline filter which employs such resonators. That is, the lower the loaded Q or $Q_L$, for a given $Q_U$, then the lower is the insertion loss of the stripline resonator filter. Resonators with a low $Q_L/Q_U$ ratio result in filters with low insertion loss. Thus, resonators in which nonuniform current distribution results in high effective resistance also results in low unloaded Q and high insertion loss.

FIG. 5 shows another resonator structure 100 substantially similar to the resonator structure 10 of FIG. 1–3 except for the following modifications. In resonator structure 100, dielectric layers 20 and 30 are fabricated from ceramic material instead of a dielectric material which becomes plastic when heated as in resonator structure 10. Moreover, in resonator structure 100, a resonator portion 70 is situated on surface 20B in the same manner that resonator portion 60 is situated on surface 30A. FIG. 5 shows dielectric layers 20 and 30 prior to being sandwiched together to form a stripline resonator. Resonator portions 60 and 70 are aligned and soldered together as shown in FIG. 6 to form a resonator 80. When dielectric layers 20 and 30 are sandwiched together to form the resonator structure of FIG. 6, it is noted that resonator 80 separates surfaces 20B and 30A. In so doing, resonator 80 forms an air gap 110 between dielectric layers 20 and 30. Although resonator structure 100 of FIG. 6 generally performs well, unfortunately the air gap 110 which is characteristic of this structure is subject to contamination which can lead to performance degradation.

BRIEF SUMMARY OF THE INVENTION

Accordingly, one object of the invention is to provide a stripline filter resonator in which the air gap is eliminated to reduce the possibility of undesired contamination.

Another object of the present invention is to provide a filter resonator which exhibits a substantially uniform current density around the periphery of the cross-section of the center conductor.

Another object of the present invention is to provide a filter resonator with high unloaded Q, $Q_U$.

Yet another object of the invention is to provide a filter resonator which is employable in a stripline filter to achieve low insertion loss.

In one embodiment of the invention, a stripline resonator structure is provided which includes a substrate of dielectric material including first and second opposed surfaces and a center. First and second ground planes are disposed on the first and second surfaces, respectively. An elliptically shaped resonator structure is situated approximately at the center of the substrate. The resonator includes a major axis oriented substantially parallel with the first and second surfaces.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1:
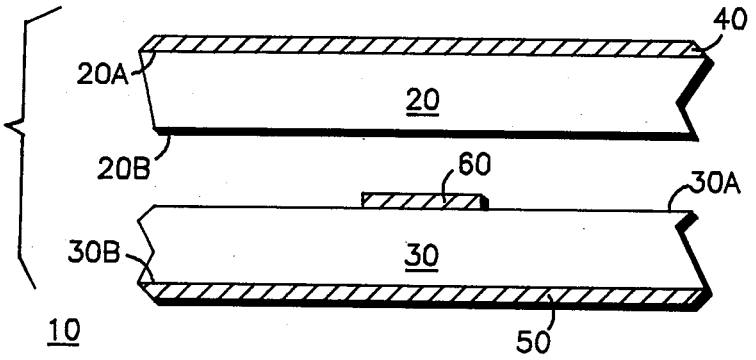
FIG. 1 is a side view of one conventional stripline resonator structure prior to sandwiching the dielectric layers thereof together.
Figure 2:
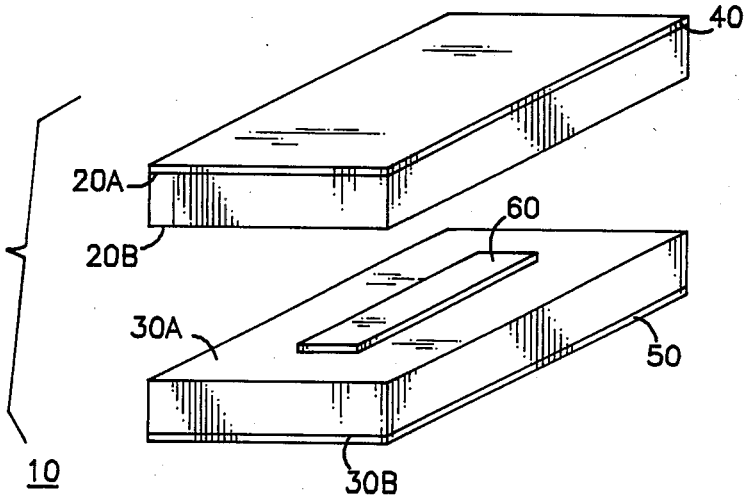
FIG. 2 is an isometric view of the conventional stripline resonator structure of FIG. 1 prior to sandwiching the dielectric layers thereof together.
Figure 3:
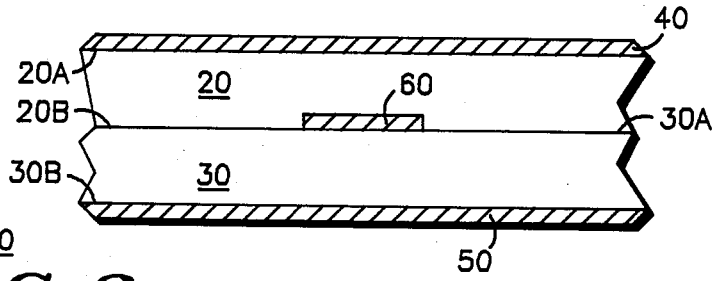
FIG. 3 is a side view of the conventional stripline resonator structure of FIG. 1 after sandwiching the dielectric layers thereof together.
Figure 4:
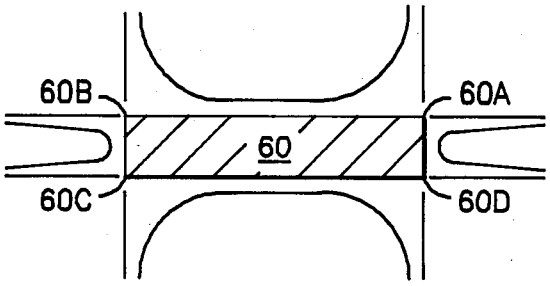
FIG. 4 is a representation of the current distribution around the periphery of the center conductor of the resonator structure of FIG. 3.
Figure 5:
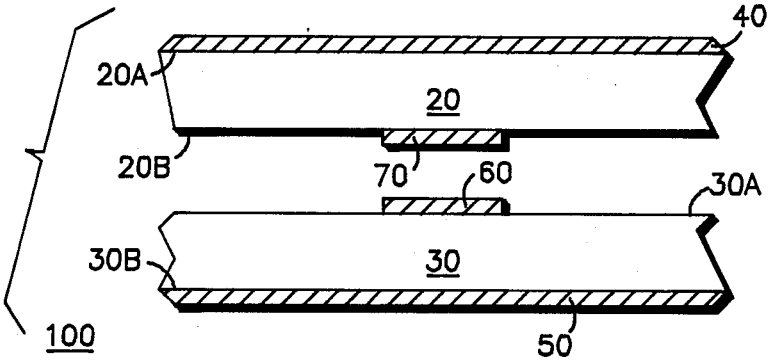
FIG. 5 is a side view of another conventional stripline resonator structure prior to sandwiching the dielectric layers thereof together.
Figure 6:
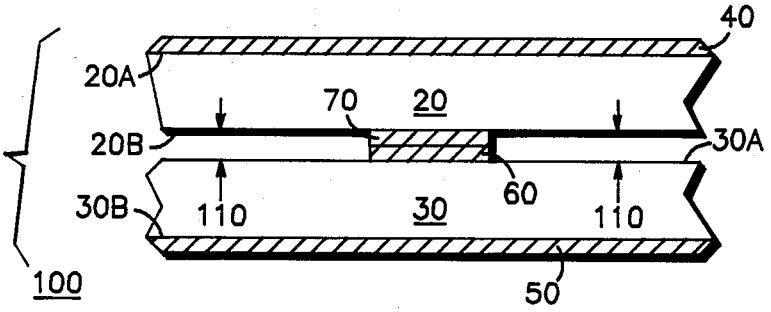
FIG. 6 is a side view of the conventional stripline resonator structure of FIG. 5 after sandwiching to dielectric layers thereof together.
Figure 7A:
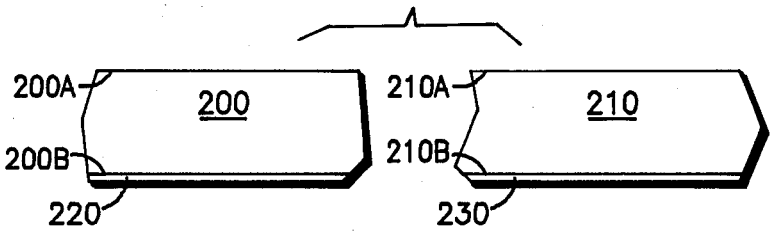
FIG. 7A is a side view of two sections of dielectric material employed in fabricating the stripline resonator of the invention.

Turning now to FIG. 7A, dielectric sections 200 and 210 are shown prior to being processed to form the resonator structure of the invention. Dielectric sections 200 and 210 are substantially identical and are formed from a dielectric material, for example a ceramic material. Sections 200 and 210 includes opposed major surfaces 200A and 200B, and 210A and 220B, respectively. Ground plane layers 220 and 230 of electrically conductive material are disposed on surfaces 200B and 210B as shown.

Figure 7B:
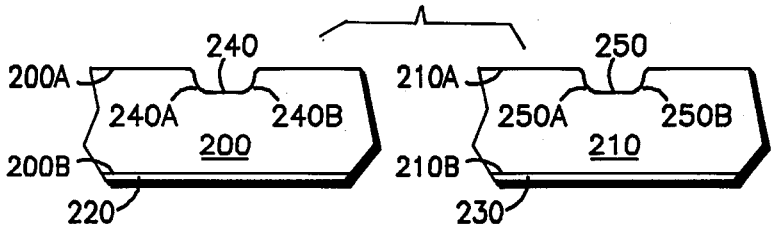
FIG. 7B is a side view of the sections of FIG. 7A with respective grooves disposed therein.

As seen in FIG. 7B, grooves 240 and 250 are machined or otherwise located in surfaces 200A and 210A. In this embodiment of the invention, grooves 240 and 250 are substantially rectangularly shaped. Grooves 240 and 250 respectively include corners 240A and 240B, and 250A and 250B. Although the geometry of grooves is generally rectangular, corners 240A, 240B, 250A and 250B are rounded.

Figure 7C:
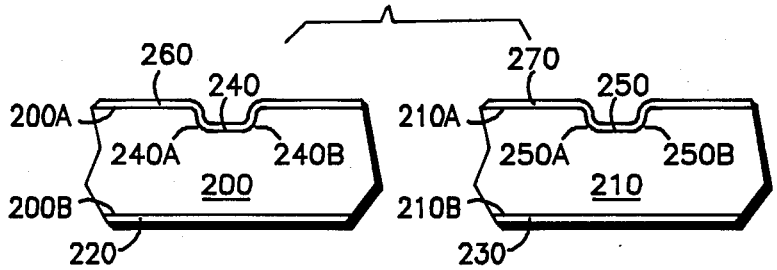
FIG. 7C is a side view of the structure of FIG. 7B after a metallic layer has been disposed over the groove of each section.
Figure 7D:
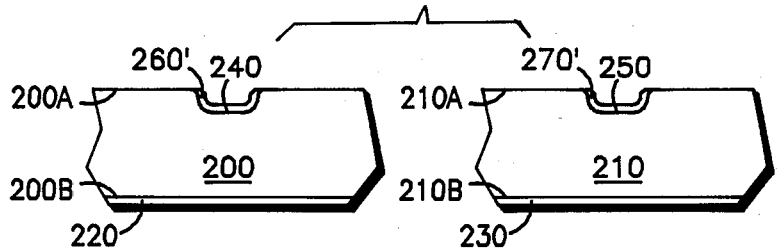
FIG. 7D is a side view of the structure of FIG. 7C after portions of the metallic layer have been removed leaving the metallic layer section thereof which is in the groove.

The surfaces of grooves 240 and 250 are then coated with a layer of electrically conductive material by covering surfaces 200A and 210A with metallic layers 260 and 270, respectively, as shown in FIG. 7C. The portions of layers 260 and 270 which are not in grooves 240 and 250, respectively, are removed. For example, layers 260 and 270 are lapped until surfaces 200A and 210A are bare as shown in FIG. 7D. When layer 260 is so removed from surface 200A, a portion of layer 260 remains in groove 240 and is designated layer 260'. Similarly, when layer 270 is so removed from surface 210A, a portion of layer 270 remains in groove 250 and is designated layer 270'.

Figure 7E:
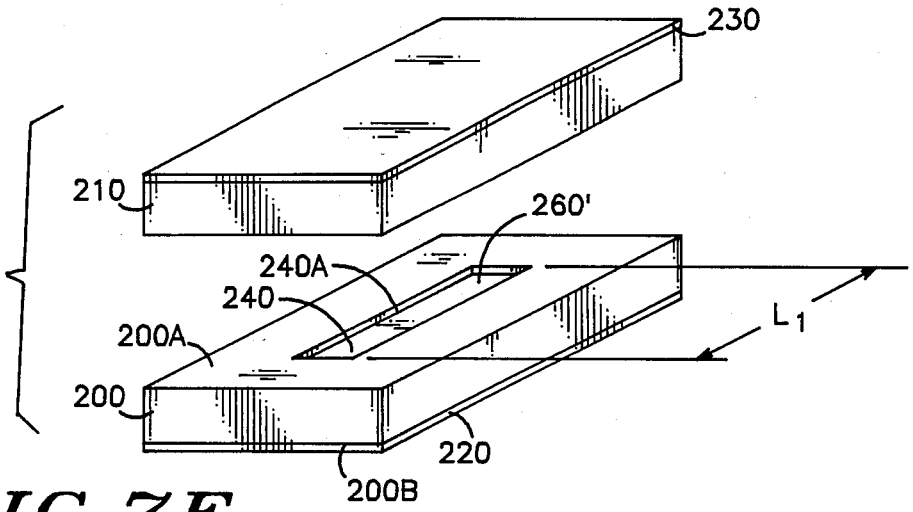
FIG. 7E is an isometric view of the two dielectric sections prior to alignment of the respective grooves.
Figure 7F:
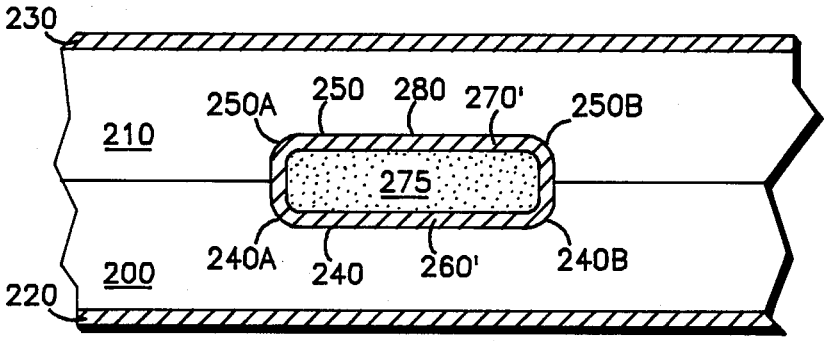
FIG. 7F is a side view of the completed resonator structure with a rectangular geometry having rounded corners.

As shown in the isometric view of FIG. 7E, section 210 is inverted prior to alignment of groove 240 with groove 250. It is noted that grooves 240 and 250 exhibit a length L1 which corresponds to one half wavelength at the desired resonant frequency of the resonator in this embodiment. Grooves 240 and 250 are filled with adhesive material 275 as seen more clearly in FIG. 7F. Grooves 240 and 250 are then aligned along their respective lengths and are mated as shown in FIG. 7F. Layers 260' and 270' each form half of a resonator 280. The adhesive material 275 within the resonator chamber formed by mated layers 260' and 270' holds dielectric sections 200 and 210 together in sandwichlike relationship. Adhesive material 275 may be either conductive, for example solder, or non-conductive, for example Epoxy TM.

Figure 8:
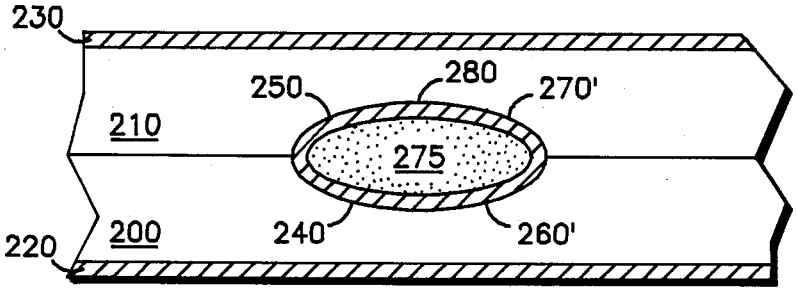
FIG. 8 is a side view of the completed resonator structure with an ellipsoid geometry.

FIG. 8 is a representation of a resonator structure which is substantially identical to the resonator structure of FIG. 7F except that grooves 240 and 250 each exhibit a half ellipsoid geometry. Thus when grooves 240 and 250 with layers 260' and 270' thereon are mated as discussed above, the geometry of the resulting resonator 280 is substantially ellipsoidal.

The unique geometry of the resonator structures discussed above results in a more uniform current density around the resonator periphery than in prior structures. Thus, current bunching is reduced and the effective resistance of the resonator is decreased. In this manner, the $Q_U$ of the resonator is significantly increased.

Figure 9:
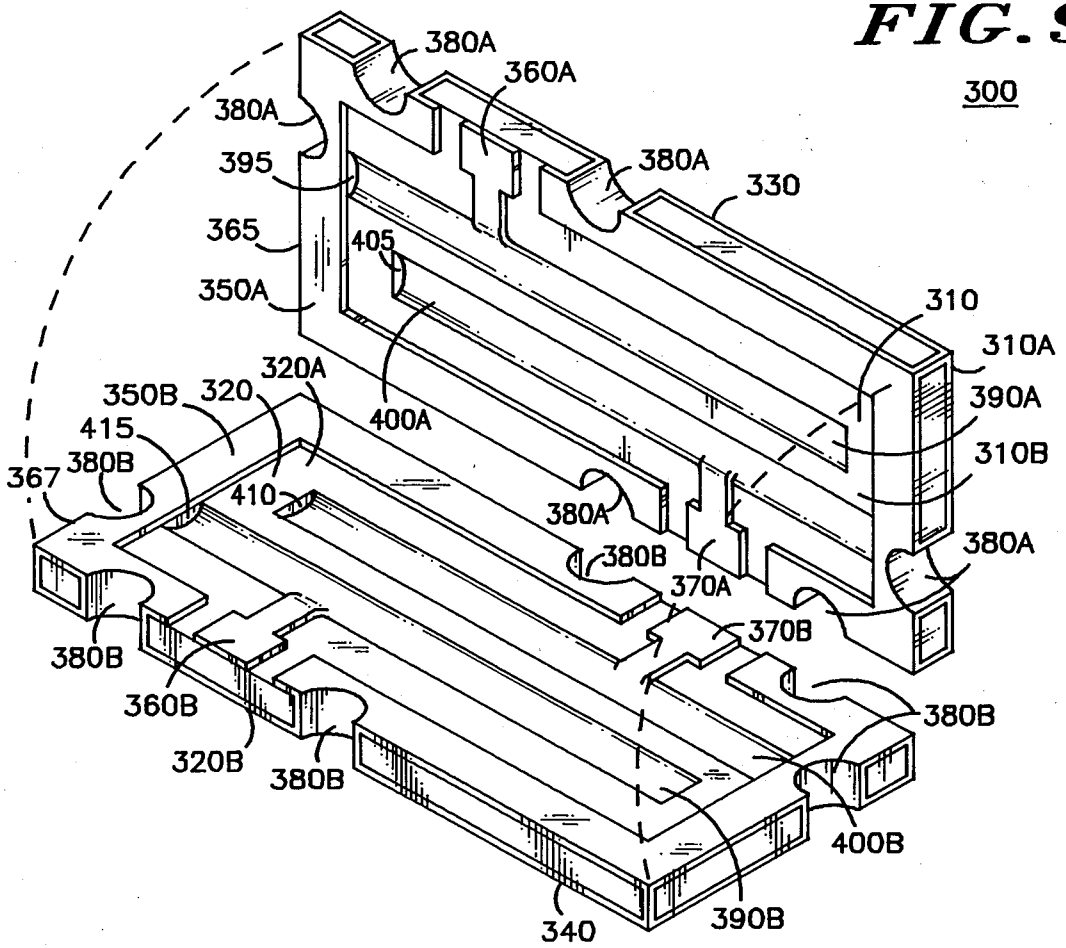
FIG. 9 is an exploded view of a filter using the improved resonator structure of the invention.

FIG. 9 shows a stripline filter 300 using the above described resonator structure. Filter 300 includes upper and lower dielectric sections 310 and 320, respectively. Dielectric sections 310 and 320 and the structures fabricated thereon are essentially mirror images of each other. More specifically, section 310 includes upper surface 310A and lower surface 320B. Section 320 includes upper surface 320A and lower surface 320B. Ground plane metallizations 330 and 340 are situated on upper surface 310A and lower surface 320B, respectively. The edges of ground planes 330 and 340 are visible in FIG. 9. Ground plane 330 and 340 cover a sufficient portion of surfaces 310A and 320B to provide a ground plane effect. Generally, ground planes 330 and 340 cover the majority of surfaces 310 and 340B.

Electrically conductive ground skirts 350A and 350B are situated around the respective peripheral edges of surfaces 310B and 320A as shown in FIG. 9. That is, ground skirt 350A is situated along substantially the entire peripheral edge 365 of lower surface 310B except for the portion of the edge 365 occupied by input pad 360A and output pad 370A. Similarly, ground skirt 350B is situated along substantially the entire peripheral edge 367 of lower surface 320A except for the portion of edge 367 occupied by input pad 360B and output pad 370B.

Ground plane 330 is connected to ground skirt 350A by plated through conductive vias 380A situated at edge 365 of section 310 as shown in FIG. 9. Ground plane 340 is connected to ground skirt 350B by plated-through conductive vias 380B situated at edge 367 of section 320.

Input 360A is connected to a resonator portion 390A shaped as half an ellipsoid. Resonator portion 390A is formed in a groove 395 within surface 310B in accordance with the method of the earlier discussion. One end of resonator portion 390A is connected to ground skirt 350A. The remaining end of resonator portion 390A is open circuited. Output 370A is connected to a resonator portion 400A shaped as half an ellipsoid. Resonator portion 400A is formed in a groove 405 within surface 310B. One end of resonator portion 400A is connected to ground skirt 350A. The remaining end of resonator portion 400A is open circuited. Resonator portions 390B and 400B are substantially identical to, and substantially mirror images of, resonator portions 390A and 400A, respectively, as shown in FIG. 9. Resonator portions 390B and 400B are situated in grooves 410 and 415 in surface 320A.

As discussed earlier, an adhesive is placed on resonator portions 390A–390B and 400A–400B such that when these respective portions are joined, dielectric sections 310 and 320 are held together. When the resonator portions are so joined, ellipsoidally shaped resonators are formed. Although in this example, ellipsoidally shaped resonators are shown, it will be appreciated that consistent with the earlier discussion, the grooves and resonators may also be substantially rectangularly shaped with rounded corners.

From the above description, it is clear that the invention involves not only a resonator/filter structure but also a method of fabricating such a resonator structure. In summary, the method includes the steps of providing a groove in a first surface of a first substrate of dielectric material including first and second opposed surfaces. A first groove surface is thus created. Another groove is provided in a first surface of a second substrate of dielectric material including first and second opposed surfaces. A second groove surface is thus created. The first groove surface is coated with electrically conductive material. The second groove surface is coated with electrically conductive material. The method continues with the step of filling the first and second groove surfaces with adhesive. The first and second groove surfaces are aligned with respect to each other such that the first and second surfaces adhere to each other via the adhesive therebetween. The second surfaces of the first and second substrates are provided with ground planes thereon.

The foregoing describes an stripline resonator apparatus and method of fabrication in which the air gap is eliminated to reduce the possibility of undesired contamination. The resonator structure exhibits a substantially uniform current density such that high unloaded Q and low insertion loss are attained.

While only certain preferred features of the invention have been shown by way of illustration, many modifications and changes will occur to those skilled in the art. It is, therefore, to be understood that the present claims are intended to cover all such modifications and changes which fall within the true spirit of the invention.

I claim:

1. A stripline resonator structure comprising:

a substrate of dielectric material including first and second opposed surfaces and a center;

first and second ground planes disposed on said first and second surfaces, respectively;

a resonator structure having an elliptically shaped cross-section situated approximately at the center of said substrate, said resonator including a major axis oriented substantially parallel with said first and second surfaces.

2. A stripline filter apparatus comprising:

a first ceramic substrate including inner and outer opposed surfaces and including a metallized ground plane situated on said outer surface;

a second ceramic substrate including inner and outer opposed surfaces and including a metallized ground plane situated on said outer surface;

at least one resonator device including first and second resonator halves situated on the inner surfaces of said first and second substrates, respectively, said first resonator half being situated in a first groove situated in the inner surface of said first substrate, said second resonator half being situated in the inner surface of said second substrate in a second groove aligned with said first groove, wherein said first and second grooves exhibit half ellipsoidal shapes; and said first and second substrates being sandwiched together with the inner surfaces of said first and second substrates facing each other.

3. A stripline filter apparatus comprising:

a first ceramic substrate including inner and outer opposed surfaces and including a metallized ground plane situated on said outer surface;

a second ceramic substrate including inner and outer opposed surfaces and including a metallized ground plane situated on said outer surface;

at least one resonator device including first and second resonator halves situated on the inner surfaces of said first and second substrates, respectively, said first resonator half being situated in a first groove situated in the inner surface of said first substrate, said second resonator half being situated in the inner surface of said second substrate in a second groove aligned with said first groove, wherein said first and second resonator halves exhibit half ellipsoidal shapes; and said first and second substrates being sandwiched together with the inner surfaces of said first and second substrates facing each other.

4. A stripline filter apparatus comprising:

a first ceramic substrate including inner and outer opposed surfaces and including a metallized ground plane situated on said outer surface;

a second ceramic substrate including inner and outer opposed surfaces and including a metallized ground plane situated on said outer surface;

at least one resonator device including first and second resonator halves situated on the inner surfaces of said first and second substrates, respectively, said first resonator half being situated in a first groove situated in the inner surface of said first substrate, said second resonator half being situated in the inner surface of said second substrate in a second groove aligned with said first groove, wherein said first and second grooves exhibit substantially rectangular geometries in cross-section with rounded corners; and said first and second substrates being sandwiched together with the inner surfaces of said first and second substrates facing each other.

5. A stripline filter apparatus comprising:

a first ceramic substrate including inner and outer opposed surfaces and including a metallized ground plane situated on said outer surface;

a second ceramic substrate including inner and outer opposed surfaces and including a metallized ground plane situated on said outer surface;

at least one resonator device including first and second resonator halves situated on the inner surfaces of said first and second substrates, respectively, said first resonator half being situated in a first groove situated in the inner surface of said first substrate, said second resonator half being situated in the inner surface of said second substrate in a second groove aligned with said first groove, wherein said first and second resonator halves exhibit substantially rectangular geometries in cross-section with rounded corners; and said first and second substrates being sandwiched together with the inner surfaces of said first and second substrates facing each other.

* * * * *